US011175067B2

(12) United States Patent
Martinez Galvan

(10) Patent No.: US 11,175,067 B2
(45) Date of Patent: Nov. 16, 2021

(54) AIR CONDITIONER WITH WATER REMOVAL

(71) Applicant: Electrolux Appliances Aktiebolag, Stockholm (SE)

(72) Inventor: Israel Martinez Galvan, Stockholm (SE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 25 days.

(21) Appl. No.: 16/099,362

(22) PCT Filed: May 10, 2016

(86) PCT No.: PCT/EP2016/060396
§ 371 (c)(1),
(2) Date: Nov. 6, 2018

(87) PCT Pub. No.: WO2017/194092
PCT Pub. Date: Nov. 16, 2017

(65) Prior Publication Data

US 2019/0212032 A1 Jul. 11, 2019

(51) Int. Cl.

| | |
|---|---|
| ***F24F 13/22*** | (2006.01) |
| ***F24F 1/022*** | (2019.01) |
| ***F24F 6/12*** | (2006.01) |

(52) U.S. Cl.
CPC ..... *F24F 13/222* (2013.01); *F24F 1/022* (2013.01); *F24F 6/12* (2013.01); *F24F 2013/225* (2013.01)

(58) Field of Classification Search
CPC .. F24F 13/222; F24F 6/12; F24F 1/022; F24F 2013/225
USPC ..... 62/280
See application file for complete search history.

(56) References Cited

U.S. PATENT DOCUMENTS

| | | | |
|---|---|---|---|
| 2,234,753 | A | 3/1941 | Frazer |
| 2008/0104989 | A1 | 5/2008 | Movshovitz |

FOREIGN PATENT DOCUMENTS

| | | | | |
|---|---|---|---|---|
| CN | 201104001 | Y | | 8/2008 |
| CN | 103471223 | A | * | 12/2013 |
| CN | 103471223 | A | | 12/2013 |
| CN | 203501389 | U | | 3/2014 |
| CN | 203518172 | U | | 4/2014 |
| JP | 54105838 | A | | 8/1979 |
| JP | 07248128 | A | | 9/1995 |
| JP | 08226745 | A | * | 9/1996 |
| JP | H08226745 | A | * | 9/1996 |
| JP | 2009144984 | A | | 7/2009 |
| JP | 2009144984 | A | * | 7/2009 |
| WO | 0190657 | A1 | | 11/2001 |

(Continued)

OTHER PUBLICATIONS

International Search Report and Written Opinion for International Application No. PCT/EP2016/060396, dated Jan. 24, 2017—9 pages.

(Continued)

*Primary Examiner* — Steve S Tanenbaum
(74) *Attorney, Agent, or Firm* — RatnerPrestia

(57) ABSTRACT

An air-conditioner having a compressor, a condenser, an evaporator, and a first water container for collection of condensed water in the air conditioner. The air-conditioner has at least one ultrasonic atomizer arranged to atomize water in the water container.

9 Claims, 5 Drawing Sheets

(56) References Cited

FOREIGN PATENT DOCUMENTS

| | | | | |
|---|---|---|---|---|
| WO | WO-0190657 | A1 * | 11/2001 | ..... F24F 6/12 |
| WO | 2012056164 | A1 | 5/2012 | |

OTHER PUBLICATIONS

Chinese Office Action for Chinese Application No. 201680085261.5, dated Apr. 14, 2020, 11 pages.
Chinese Office Action issued in Chinese Patent Application No. 201680085261.5, dated Dec. 11, 2020, with translation, 28 pages.
European Communication pursuant to Article 94(3) isssued in European Application No. 16 721 184.6, dated Oct. 7, 2020, 7 pages.

* cited by examiner

AIR CONDITIONER WITH WATER REMOVAL

This application is a U.S. National Phase application of PCT International Application No. PCT/EP2016/060396, filed May 10, 2016, which is incorporated by reference herein.

TECHNICAL FIELD

The present disclosure relates to an air-conditioner. In particular the present disclosure relates to a portable air-conditioner.

BACKGROUND

Air conditioning (AC) is a collective expression for conditioning air into a desired state. It could be heating the air during cold periods, cooling the air during warmer periods or for cleaning the air if it contains unwanted particles. However, the expression air conditioning is most often used when emphasizing cooling. As a product, air conditioners can look and be used in various ways, but they all share the same basic technology.

Existing portable air-conditioners are often found to be large, hard to handle, noisy and inefficient. Furthermore, the connected exhaust air outlet that removes the heat from the room is often complicated and inefficient in its design. A known portable air-conditioner is for example described in the U.S. Pat. No. 2,234,753.

The design of portable AC systems differs from other Air Conditioners because all the components of the system are mounted inside of a packed unit which has to work inside of the conditioned space, releasing the residual energy (generated in the normal cooling process) through an air exhaust system which is usually connected to the outside.

In portable AC units there are two general procedures to cool down an air source condenser: single duct and dual duct methods. In the first one (single duct), the system takes air from its surroundings (conditioned space), forcing it to pass through the condenser surface and eventually removing the residual energy from it. Then, the hot air is expelled outdoors by using a single duct system. In this method, the intake air temperature has the indoor temperature conditions, which makes the energy exchange process more beneficial from standpoint of the refrigerant cycle.

In the dual duct method, the system uses an air intake duct to inject "hot" air from outdoor to cool down the condenser. Eventually the air coming from condenser at a relatively high temperature is released outdoors again by a secondary exhaust duct. In this method the air intake temperature is at the outdoor temperature conditions. This method can provide a quicker cooling effect for the user, since the system is not using the indoor air as a coolant media for condenser, but requiring in turn a larger size/volume of components to compensate the higher inlet outdoor temperatures.

Both methods, single and dual duct, have different limitations in terms of: air flow rates, size of the heat exchangers and also dimensions of the air piping system.

Those particularities requires that the portable AC systems make use of particular size of condensers, limiting the maximum air flow rate used by the system, since the air intake and air exhaust systems have to be as much compact as possible.

Other common limitation in Air Conditioners, particularly in portable units, is the generation of condensed water on the evaporator surface, especially in high humidity environments. Excess of water limits the continuous operation of the system, forcing a manual process for emptying a water tank, specially implemented for containing the condensed water.

One standard way commonly used to remove part of the condensed moisture generated in the normal operation of portable AC systems is the method of (hipping water over the condenser surface. This method helps to remove part of the water by evaporation, but it also helps to improve the heat rejection process in the system. However, under high humidity conditions, the evaporation of the condensed water is not always possible.

In addition to the water dripping method, some systems include the use of a mechanical wheel that splashes the excess of non-evaporated water from the bottom of condenser over its surface. This secondary mechanism improves the elimination of the excess of water, by dragging the water droplets that are not evaporated, through the air stream that crosses the condenser.

The abobe methods help to remove part of the undesired condensed water generated in the normal operation process of the system and also to decrease the condensing temperatures in the cycle. However, they require larger spaces inside of the system for the installation of the motor, and the wheel. They also tend to be noisy and its efficiency to remove water is also limited. Hence, all excess water will not always be removed.

There is a constant desire to improve the operation of air-conditioners.

Hence, there is a need for an improved air-conditioner.

SUMMARY

It is an object of the present invention to provide an improved air-conditioner that at least pa V solves problems with existing air-conditioners.

This object and others are obtained by the air conditioner as set out in the appended claims.

In accordance with one embodiment an air-conditioner comprising a compressor, a condenser, an evaporator, and a first water container for collection of condensed water in the air conditioner is provided. The air-conditioner is further provided with at least one ultrasonic atomizer arranged to atomize water in the water container. Hereby an improved water removal in the air-conditioner can be obtained.

In accordance with one embodiment ultrasonic atomizer(s) is/are arranged at a bottom side of the first water container. Hereby the efficiency of water removal can be improved.

In accordance with one embodiment the first water container is located under the condenser to even further improve the water removal efficiency.

In accordance with one embodiment at least one water level sensor can be arranged to sense the water level in the first water container and the air-conditioner is adapted to control the water level in the first water container to a pre-determined level or within a pre-determined water level range using input signals from the at least one water level sensor. Hereby the ultrasonic atomizer(s) can be protected.

In accordance with one embodiment water is led directly from the evaporator to the first water container.

In accordance with one embodiment at least one ultrasonic atomizer is adapted to create a mist flow, said mist flow flowing across fins and or tubes arranged at the condenser.

In accordance with one embodiment a second water container. The second water container can be smaller than the first water container and adapted to collect water for a pre heat exchange between water coming from the evaporator and a discharge pipe from the compressor.

In accordance with one embodiment a water distributor can be provided and adapted to distribute water over the condenser. The water can be pumped from a water container of the air-conditioner.

The air-conditioner can advantageously be a portable air-conditioner.

BRIEF DESCRIPTION OF THE DRAWINGS

The present invention will now be described in more detail by way of non-limiting examples and with reference to the accompanying drawings, in which.

DETAILED DESCRIPTION

The invention will now be described more fully hereinafter with reference to the accompanying drawings, in which certain embodiments of the invention are shown. The invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
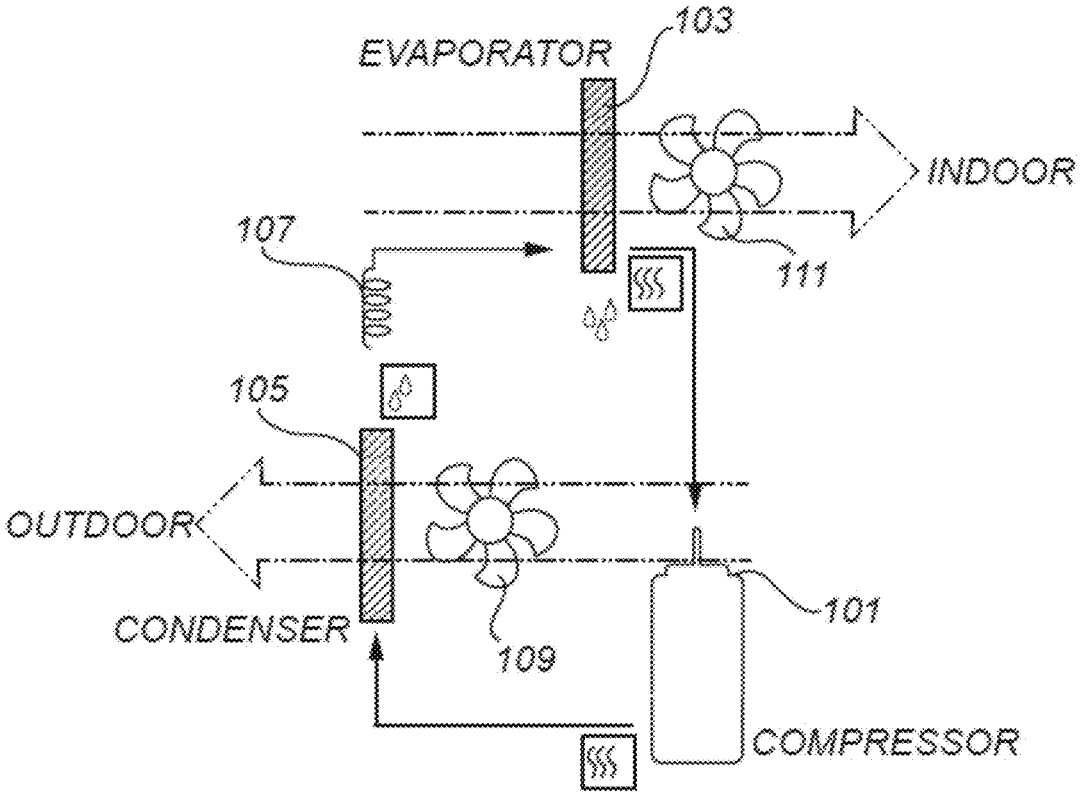
FIG. 1 illustrates the general principles of an air conditioner system.

FIG. 1 illustrates the general principles of an air conditioner system 100. The main parts of the system are the compressor 101, evaporator 103, condenser 105, and expansion device 107 such as a capillary tube. Also a condenser fan 109 and an evaporator fan 111 can be provided. The compressor 101 is connected in a circuit with the condenser 105, the evaporator 103, and the expansion device 107. A refrigerant is circulated in the circuit. The refrigerant has the ability to turn from liquid into vapor, and by that change in temperature. The tempered refrigerant and the indoor air work in symbiosis to exchange heat to each other.

As set out above the excess of condensed water generated in the normal operation of AC systems, especially portable AC units working under high temperature and humidity conditions can be difficult to manage. By using an ultrasonic atomizer device (also termed ultrasonic nozzle) as an alternative or supplemental device to e.g. a standard water splashing wheels, commonly used in portable AC units, an improved air conditioner that better can handle excess of condensed water can be obtained.

Ultrasonic atomizers comprises piezoelectric transducers that produce high frequency mechanical oscillations just below the surface of the water. These oscillations create a very fine and dense fog that is instantaneously evaporated into the air stream, especially when the air is at high temperature.

Among other advantages, the use of ultrasonic atomizers allows the creation of a continuous flow of small droplets of water (mist flow), requiring a minimum amount of energy, capable to work in a silent way, without moving parts and atomizing high rates of water in short periods of time.

The atomized water generated by the ultrasonic cells has the particularity of being formed by water droplets with very small diameters (0.5 microns or lower), which are much smaller than the ones created by the standard splashing wheel method. This ability to generate small water droplets has been found to be beneficial for the water removal process, because the air stream that crosses the condenser can carry the mist flow out in an easier and quick way, since the weight of the droplets is very low because of their size.

Additionally, the amount of droplets generated is also high because of the high vibration frequencies of the ultrasonic discs. Under those conditions, the capacity of the dry air to mix with the mist flow and "absorb" the moisture is also higher, leading to a high efficiency water removal process.

Figure 2:
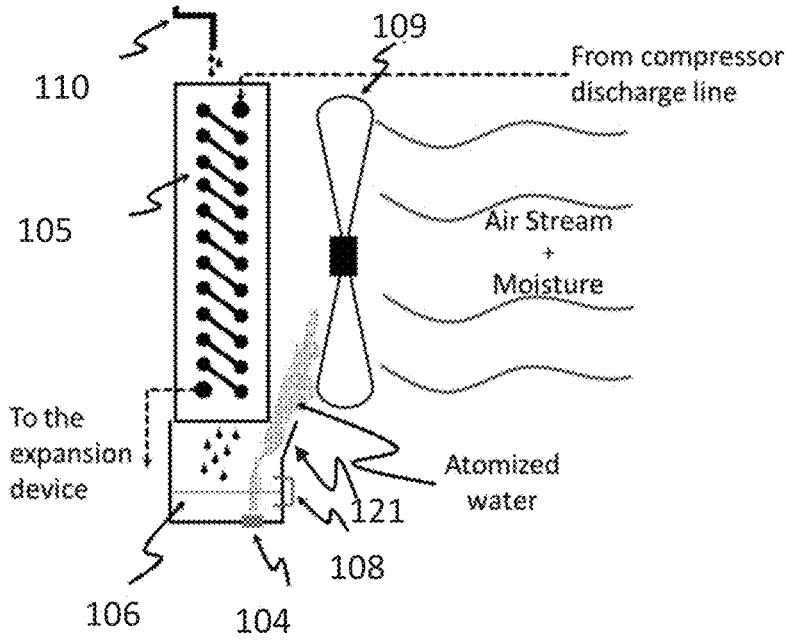
FIG. 2 illustrates an air-conditioner in accordance with a first embodiment.

In FIG. 2 a part of an exemplary air conditioning system is shown. In accordance with the exemplary embodiments shown in FIG. 2, the system comprises at least one and in some instances a set of ultrasonic atomizers 104. The ultrasonic atomizer(s) 104 can for example be located at a bottom side of a water container 106 of the air conditioning system 100. The water container 106 can advantageously be located under the air source condenser 105. In accordance with some embodiments the water container 106 is provided with a bent section 121 in its inner wall, which allows a better flow of the mist generated by the ultrasonic atomizer(s) 104. The bent section 121 is bent in relation to at least a part of the inner wall of the water container. By providing a wall of the water container 106 that is not straight, but which has an upper end that is bent, the inner wall of the water container 106 will have a soft outlet in its inner top border, which facilitates the flow of the mist generated by the atomizers. The water container 106 can also include a set of water level sensor(s) 108 to control the amount of water stored in the water container 106 to protect the ultrasonic atomizers. The water level in the water container 106 can therefore be controlled using the water level sensor(s) to a pre-determined level or within a predetermined water level range.

In accordance with one mode of operation, the air conditioning system 100 uses condensed water coming from the evaporator 103 as indicated by reference numeral 110 to assist the heat rejection process of the condenser 105, and evaporating simultaneously part of that water flow. Then, the remaining non-evaporated water can drop into the water container 106 to be atomized by the ultrasonic atomizer(s) 104 and finally removed, for example by an air stream that is blown by the condenser fan 109. At these conditions, the air stream that crosses the condenser 105 has a higher temperature and a lower relative humidity, therefore its capacity to "retain" the atomized water is higher because the saturation pressure of water vapour and the maximum humidity ratio of the dry air increases dramatically with air temperature, which is especially high after crossing the condenser.

The air conditioning system 100 as described herein can be adjusted in different ways to improve the removal process of the condensate generated in the evaporator, and to assist the heat rejection process of condenser.

Adjustments to improve water removal can in accordance with some embodiments include the use of different number of ultrasonic atomizers, with different geometries and cell sizes. Additionally, the working frequency of the piezoelectric transducers can be adjusted to control the amount of mist generated and the quantity of water removed from the air conditioning system.

Figure 3:
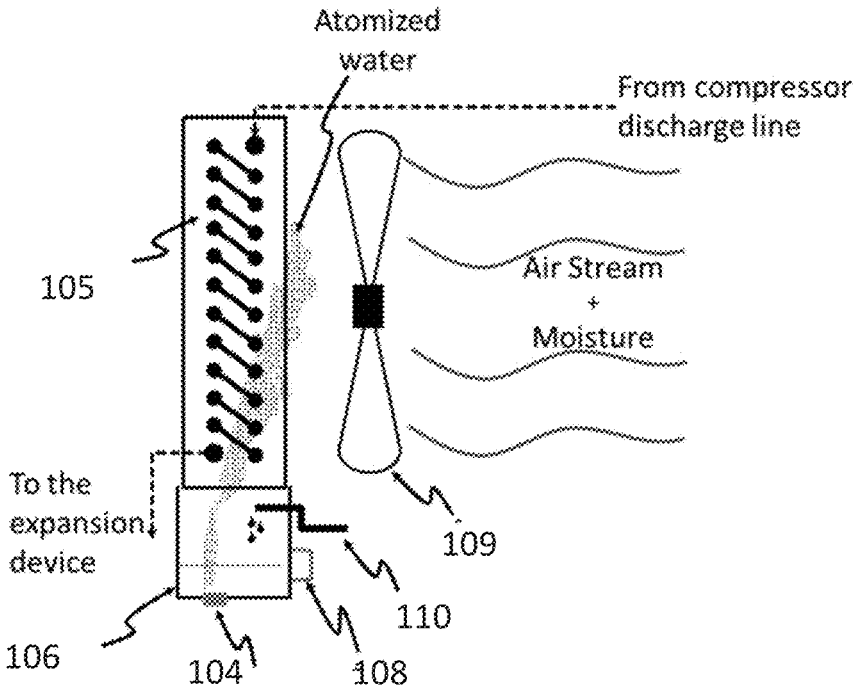
FIG. 3 illustrates an air-conditioner in accordance with a second embodiment.

In accordance with other embodiments different geometries for the water tank 106 can be provided. In still other embodiments the layout of the Air-conditioning system can be altered. In accordance with one embodiment the water 110 from the evaporator is led directly inside of the water container 106 and use the ultrasonic atomizers 104 to create a mist flow that can flow across the fins and or tubes of the condenser 105, humidifying its surface and removing part of the heat load at the time that the excess of condensate is removed through the air stream. Such a configuration is shown in FIG. 3.

In accordance with the embodiment shown in FIG. 3, the water container 106 is located below the condenser. The water container 106 can have a simple rectangular section without any specific geometry to facilitate the mist removal process. In such an embodiment, the mist generated by the atomizers will be forced to flow through the fins and tube condenser by the condenser fan 109. Additionally, the use of a water level sensor and an associated control system can be used to control the water storage in the water container 106 and to control the amount of water removed from the air conditioning system 100.

Figure 4:
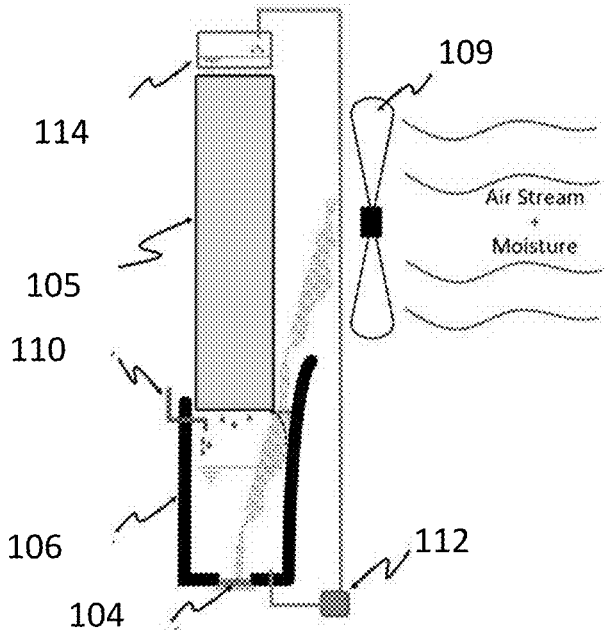
FIG. 4 illustrates an air-conditioner in accordance with a third embodiment.

In accordance with some other embodiments a water pumping system, as the primary method to evaporate the excess of condensate, is combined with the use of a number of ultrasonic atomizers. Such a configuration is shown in FIG. 4 which shows a water pump 112 provided in the air conditioning system. An advantage of the exemplary embodiment shown in FIG. 4 is that a water pumping system can be used to provide part of the water elimination and can assist in an efficient way the heat rejection process of the condenser, due to a better and homogeneous humidification of the condenser surface achieved by the water pump. The ultrasonic atomizers 104 can be used to assist the water removal process specifically under the high humidity conditions, where the evaporative method is insufficient. The number of ultrasonic atomizers 104 can in such an embodiment be reduced compared to the embodiment shown in FIG. 2.

In the embodiment shown in FIG. 4, a water pump 112 is connected between the water container 106, located in the bottom of the condenser, and a water distributer 114 placed on the condenser 105 top.

The water distribution system comprises a closed channel with one water inlet of the water distributor 114 and a set of small holes in its bottom side, which cause a slight pressure drop in the water flow due to the holes diameters. The diameter of the holes can in accordance with some embodiments be in the range of 1 to 3 mm. Thus the water distribution system comprises a water distributor 114 adapted to distributing water onto the condenser 105.

A pressure drop created by the holes in the water distributor 114 causes an increase of the outlet velocity of the water, but it can also act so that the channel can be always filled with water, to ensure a homogeneous water flow distribution along the condenser surface.

Condensed water 110 from the evaporator 103 can be released directly to the water container 106. The water container 106 can have a soft outlet angle in its inner wall, which creates an outlet section that allows a better flow of the mist generated by the atomizers 104 as described above.

Additional variations to the embodiments described above can include different arrangements for the management of the water that comes from the evaporator, with the purpose of improving the performance of the refrigeration cycle.

Such modifications can include for example a pre heat exchange process between the condensed water coming from the evaporator and the hot discharge gas pipe from compressor, previous to the water enters into the tank and starts its removal process through the water pumping system and the atomizers.

Figure 5:
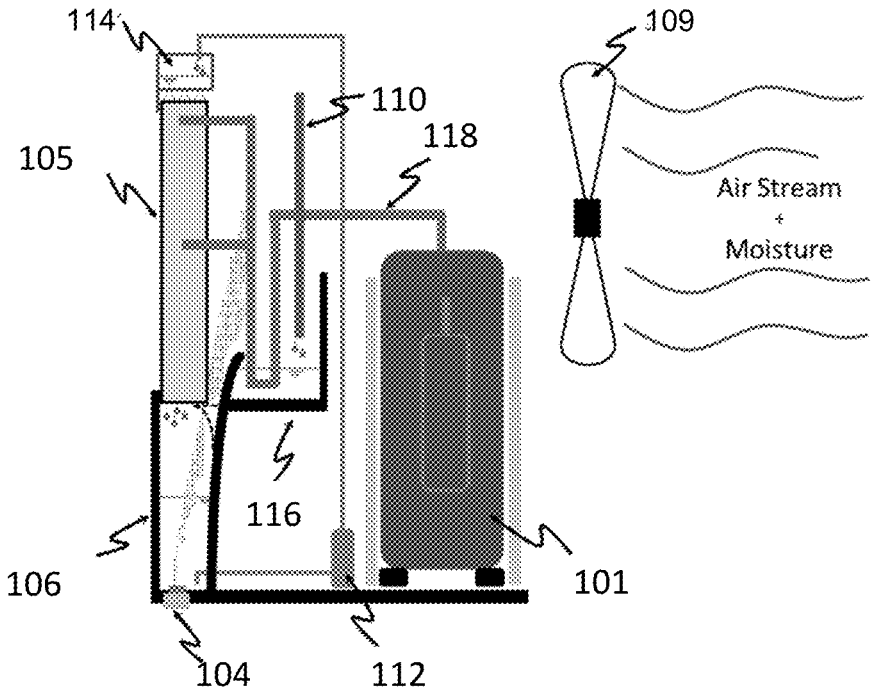
FIG. 5 illustrates an air-conditioner in accordance with a fourth embodiment.

In FIG. 5 another exemplary embodiment is depicted. In FIG. 5, the air conditioner system comprises a compressor 101, condenser 105, and a water container 106. The water container 106 can be located below the condenser. The system of FIG. 5 further comprises a second water container 116. The water container 116 can be a small tank and further be adapted to collect water for the pre heat exchange between the water 110 coming from evaporator and the hot discharge pipe 118 from compressor 101. As is shown in FIG. 5, the air-conditioner system can further comprise a set of ultrasonic atomizers 104 inside of the water container 106, a water pump 112, a water distributor 114 over the condenser 105, and also a condenser fan 109 that blows the air through the condenser 105, and the moisture removed from the system.

Other additional variation can include a different arrangement for the management of the water from evaporator. Such arrangements can comprise a pre-energy exchange between the condensed water from the evaporator and the outlet pipe from condenser (liquid line of the refrigeration cycle). An advantage such an arrangement is an additional degree of sub-cooling in the cycle that will represent an increase of its cooling capacity.

The air-conditioning system as described herein provides an improved removal of the excess of condensed water generated by the normal operation of Air Conditioners, particularly working under extreme humid and high temperature conditions. The air-conditioning system as described herein can be used for all AC systems in general, but is particularly advantageous to portable AC systems working with air source heat exchangers. By removing the excess of water, the AC systems can run longer periods of time without the interaction of the user for erupting the water tank that stores the condensate.

The air-conditioning system as described herein further allows for effective removal of the undesired condensed water generated in the cooling process, at the time that the system assists the heat rejection process carried out by the condenser, improving the efficiency of the thermal cycle.

Further, the use of ultrasonic atomizers in an air conditioner system has been shown to create of a continuous mist flow requiring a reduced amount of energy compared to pre-existing methods of removing water, and is capable to work in a more silent way, without moving parts and atomizing high rates of water in short periods of time. The atomizers can generate water droplets with diameters close to 0.5 microns, which are much smaller that the droplets produced by standard splashing systems conventionally used in Air Conditioners.

The capacity of the ultrasonic atomizers to create small diameter water droplets has been shown to be especially beneficial for the water removal process in Air Conditioners, because the air stream that crosses the condenser can carry the mist flow in an easier and quick way, since the weight of the droplets is very low because of their size.

Additionally, the amount of droplets generated by ultrasonic atomizers is also high because of the high vibration frequencies of the ultrasonic discs. Under those conditions, the capacity of the dry air to mix with the mist flow and "absorb" the moisture is also higher, leading as a consequence to high efficiency water removal process in comparison to the standard methods currently used.

An additional advantage of the ultrasonic atomizers when used in an air-conditioner for water removal is the capacity to regulate the oscillation frequency of the piezoelectric transducers by means an electronic control, and in turn the amount of water that is dragged from the system.

The invention claimed is:

1. An air-conditioner comprising:

a compressor;

a condenser;

an evaporator;

a fan;

a first water container located under the condenser for collection of condensed water in the air conditioner, the first water container including a bent wall extending away from the condenser; and one or more ultrasonic atomizers located directly under the condenser in the first water container, the one or more ultrasonic atomizers configured to atomize water in the first water container, wherein the fan is configured to generate an airstream that directs the atomized water along the bent wall to bypass the condenser.

2. The air-conditioner according to claim 1, wherein at least one of the one or more ultrasonic atomizers is arranged at a bottom side of the first water container.

3. The air-conditioner according to claim 1, further comprising at least one water level sensor configured to sense a water level in the first water container and wherein the air-conditioner is configured to control the water level in the first water container to a pre-determined level or within a pre-determined water level range using input signals from the at least one water level sensor.

4. The air-conditioner according to claim 1, wherein the air-conditioner is configured to direct water directly from the evaporator to the first water container.

5. The air-conditioner according to claim 1, further comprising a water distributor adapted to distribute water over the condenser, the water being pumped from the first water container of the air-conditioner.

6. The air-conditioner according to claim 1, wherein the air-conditioner is a portable air-conditioner.

7. The air-conditioner according to claim 1, further comprising a second water container.

8. The air-conditioner according to claim 7, wherein the second water container is smaller than the first water container and adapted to collect water for a pre heat exchange between water coming from the evaporator and a discharge pipe from the compressor.

9. An air-conditioner comprising:

a compressor;

a condenser;

an evaporator;

a fan;

a first water container located under the condenser for collection of condensed water in the air conditioner; and one or more ultrasonic atomizers located directly under the condenser in the first water container, the one or more ultrasonic atomizers configured to atomize water in the first water container, wherein the fan is configured to generate an airstream that directs the atomized water through a bottom portion of the condenser and then away from and bypassing a top portion of the condenser.

* * * * *